US006562285B1

(12) United States Patent
Demysh

(10) Patent No.: US 6,562,285 B1
(45) Date of Patent: May 13, 2003

(54) METHOD AND APPARATUS FOR DETECTING SLAG CARRYOVER

(75) Inventor: Lucas A. Demysh, Milton (CA)

(73) Assignee: Metallurgical Sensors, Inc. (CA)

( * ) Notice: Subject to any disclaimer, the term of this patent is extended or adjusted under 35 U.S.C. 154(b) by 0 days.

(21) Appl. No.: 09/713,645

(22) Filed: Nov. 15, 2000

(51) Int. Cl.[7] ..... C21B 7/24
(52) U.S. Cl. ..... 266/44; 266/100
(58) Field of Search ..... 266/99, 100, 44; 164/452, 155

(56) References Cited

U.S. PATENT DOCUMENTS 4,222,506 A 9/1980 Sakashita et al.
5,110,365 A 5/1992 Carter
5,242,014 A * 9/1993 Takahashi et al. ..... 164/452
5,301,621 A 4/1994 Vassiliou et al.
5,360,051 A * 11/1994 Takahashi et al. ..... 164/155.3
5,629,706 A 5/1997 Baath
5,694,480 A 12/1997 Itakura
5,968,227 A 10/1999 Goldstein et al.

* cited by examiner

*Primary Examiner*—Scott Kastler
(74) *Attorney, Agent, or Firm*—Andreales, Sceales, Starke & Sawall

(57) ABSTRACT

A method for representing slag in a molten metal stream is disclosed, comprising the steps of obtaining and storing digital images of the molten metal stream, identifying areas of similarity on the basis of texture and intensity, defining a subset of those areas, comparing at least one selected property of the subset against a defined parameter and generating an output signal on the basis of the comparison, wherein the output signal is indicative of the presence or absence of slag. Also disclosed is a system for carrying out the above method and visually displaying the resulting output signals to facilitate operator analysis of the results. The system allows use of inexpensive optical equipment in place of an expensive infrared detection apparatus.

56 Claims, 6 Drawing Sheets

METHOD AND APPARATUS FOR DETECTING SLAG CARRYOVER

FIELD OF APPLICATION

This invention relates to a method and system for the detection of impurities in a flow of molten metal.

BACKGROUND OF THE INVENTION

In the art of refining steel there exists the well known problem of minimizing slag carryover from one vessel to another, for example from a tundish to a mould, or as in the example noted below from a basic oxygen furnace to a ladle. In the refining process, raw steel, with certain impurities, is heated in a basic oxygen furnace (BOF) as pure oxygen is introduced. The impurities in the molten metal oxidize and form slag, leaving the purified molten metal. One of the properties of the slag is that it is less dense than the molten steel and as such it floats to the surface of the container. Traditionally, for pouring the molten metal, the BOF is tilted upon an axis and the container is tapped below a point where the slag should lie. In this manner, the refined steel can be poured into the ladle without the slag. As the amount of steel in the BOF is reduced, there is a greater probability that turbulent flow will cause slag carryover into the ladle. This is undesirable because of the great expense that must be incurred to remove the slag from the ladle, or to condition the metal so that the remaining slag is less reactive in later processes.

To prevent slag carryover, a method of slag detection is required so that when the detected slag exceeds a predetermined amount the pouring process is halted. Typically the pouring process is halted through closing the tap and the restoration of the BOF to an upright position. The process of detecting slag however still poses problems as a result of the environmental conditions of a steel foundry. The conditions in a steel mill do not easily lend themselves to human intervention in the pouring process, unless it is intervention from a distance. Another problem is that as a result of the high temperatures, molten steel appears similar to molten slag to the unaided eye of an operator.

Many techniques have been applied in an attempt to solve these problems, but the solutions are either ineffective or costly to implement, and in some cases both. Despite the fact that slag has a different consistency than molten steel, the high temperatures that are present heat both compounds and render the visual identification of the differences difficult for a human operator.

One currently used system is described in U.S. Pat. No. 5,968,227, to Goldstein et al, entitled "System and Method for Minimizing Slag Carryover During the Tapping of a BOF Converter in the Production of Steel". This patent teaches the use of an infrared detection system to determine if slag has entered the stream between the BOF and ladle. The range of IR wavelengths selected for use in this invention is only minimally blocked by the water and carbon dioxide gasses that surround the steel making process. This allows the IR camera to be located far enough from the source of heat that background heat does not interfere with the imaging. When the camera images the stream, it converts the stream into a collection of discretized elements. Typically, each element is a pixel, each with an intensity that is related to its thermal levels. A microprocessor is then able to analyze the distinct elements and compare their intensity values with known temperatures from a lock-up table. This allows a digitized image to be constructed for display on a monitor. The images shown on the monitor, having been through the digitization process, are able to clearly shown an operator the presence of slag, due to its different colouration. An embodiment is also described whereby a computer would be able to analyze the contrast of the image and determine the slag content so that automated termination of the pouring can be achieved. Though this method is effective it is also expensive. As noted above, to avoid the problems caused by the omnipresent carbon dioxide and water vapours, IR wavelengths are the chosen radiation for analysis. This requires expensive and delicate imaging equipment, and also requires a delicate calibration process that, if performed incorrectly, will produce results far from the ideal. In addition, as with all electrical equipment in environments as hostile as a steel mill or foundry, there is a need for periodic recalibration, which may require the temporary cessation of activities, which is highly undesirable.

Another prior art method is illustrated in U.S. Pat. No. 4,222,506 to Sakashita et al, entitled "Molten Steel Outflow Automatically Controlling Device". This patent is specifically related to the detection of slag in the stream between the ladle and a tundish. The patent teaches the use of an infrared camera connected to a colour monitor, where the infrared image values are mapped to visible parts of the spectrum for display purposes. As the image is displayed it is analysed for the presence of yellow colouration in what should be the red stream of the steel. If more yellow appears than is defined in a threshold, an indication is given that the pouring should stop. This technique would work poorly in the BOF-to-ladle environment due to the prevalence of particulate matter, which blocks much of the information that the infrared camera is supposed to detect. In addition, gaseous matter, such as water and carbon dioxide, would interfere with the imaging to such an extent that the method would be ineffective for proper control of slag carryover. A further problem with this method is that the equipment has to be calibrated carefully so that there is a clear delineation between the molten metal and the slag. Miscalibration of the equipment will lead to performance greatly below the ideal. In addition, as a result of the environment to which the electrical equipment is subjected, periodic recalibration of the equipment is necessary, which results in additional costs.

It would be desirable to provide a method to accurately detect and display the presence of slag in the stream between two vessels, such as between the BOF and the ladle, or between the ladle and the tundish, while avoiding the use of unnecessarily expensive equipment that has a limited service life. It would further be desirable to provide such a method wherein the results of the detection process are displayed in such manner that an operator can reliably be alerted to the presence of slag so that pouring can be terminated when deemed necessary to prevent excess slag carryover.

SUMMARY OF THE INVENTION

It is an object of the invention to obviate or mitigate at least one disadvantage of previous methods and systems. It is a further object to provide a method and system for the detection of impurities in a flow of molten metal.

The present invention provides a method of representing slag in a molten metal stream comprising at least the following steps. The first step is to obtain and store a plurality of pairs of first and second digital images of the molten metal stream. The second step is to compare one or more selected properties of said stored first and second digital images of each pair which are representative of the presence or absence of slag in said stream. The third step is to obtain a molten metal flow delta on the basis of the above comparison, the delta representing the amount of slag in the stream and the rate of change in the amount of slag. The fourth step is to generate output signals which are representative of the molten metal flow delta.

The output signals may be displayed on level meters and numerical displays or used to initiate alarms indicative of the slag content exceeding a threshold or used to distinguish slag from the molten metal flow through the colourization of slag on a display.

The first and second digital images may be characterized as first and second histograms which are compared to identify changes between the histograms that representative of the presence or absence of slag. These histograms may be based on pixel intensity levels which may be adjusted on the basis of automatic gain control levels read from the digital imaging equipment.

The comparison of the digital images may be done through a process comprising as a first step, the identification of the first and second digital images respectively as first and second sets of areas of similarity, these areas of similarity being connected areas of pixels and defined on the basis of texture and intensity. The second step is to define first and second subsets of the respective first and second sets of areas of similarity, and the third step is to compare at least one selected property of each of the first and second subsets against a defined parameter outside of which parameter the property is indicative of the presence or absence of slag. Each subset is comprised of an area of similarity having an aspect ratio of height to width of said area, and the selected property comprises said aspect ratio. The defined parameter is a numerical value for the aspect ratio, in excess of which, it is indicative of the presence of slag. This threshold may be a numerical value greater than or equal to one. The histogram analysis described above may be employed after regions of similarity are defined, and the histograms are built based on at least one selected property of said first and second subsets which is indicative of the presence or absence of slag in said stream. A digital filter is applied to the first and second images prior to comparing their properties to reduce noise and digitization artifacts.

The present invention also provides a method of representing slag in a molten metal stream comprising at least the following steps. The first step is to obtain and store a digital image of the molten metal stream. The second step is to identify the digital image as a set of areas of similarity, said areas of similarity being connected areas of pixels and defined on the basis of texture and intensity of said images. The third step is to define a subset of the areas of similarity. The fourth step is to compare at least one selected property of said subset against a defined parameter for said property, outside of which parameter said property is indicative of the presence or absence of slag. The fifth step is to generate output signals based upon the results of said comparison which are representative of the presence or absence of slag in said molten metal stream.

All the above embodiments of the invention can be performed with a charge coupled device as the digital imaging device. Preferably, the digital imaging device is sensitive to wavelengths less than 4 microns, and the digital imaging device includes an optical filter, such as a neutral density filter or a cobalt blue filter.

The present invention provides a method of reducing slag carryover into a second vessel during pouring of a molten metal stream containing slag from a first vessel into the second vessel. This method comprises representing said slag in said molten metal stream in accordance with the method described above and then terminating or regulating said pouring on the basis of information upon the amount of slag in said stream derived from said output signals. The decision to terminate or regulate said pouring is made on the basis of information upon the amount of slag in said stream derived from the visual displays, or the numerical display.

The present invention also provides a system for representing the slag content of a molten metal stream comprising at least the following elements. The first element is a digital imaging device for providing a plurality of pairs of first and second digital images of said molten metal stream. The second element is a memory, operatively connected to the digital imaging device, for storing said first and second digital images. The third element is a comparator, operatively connected to the memory, for providing a comparison signal based on a comparison of one or more selected properties of said first and second digital images in each pair which are representative of the presence or absence of slag in said stream. The fourth element is a processor, operatively connected to the comparator, for receiving and processing the comparison signal to provide a molten metal flow delta which is representative of the amount of slag in said stream and the rate of change in said amount and generating output signals which are representative of said molten metal flow delta. There may be provided a visual display to which the output signals are applied, providing a numerical display of the slag content of the molten metal flow, or a visual display of said molten metal stream with regions of slag flow appearing differently from regions of metal flow upon said display, and wherein said processor selectively applies said output signals to one or the other of said regions to enhance the visual differences between said regions. These visual enhancements may be applied to the regions of slag and said regions of slag flow colourized to enhance the visual differences between said regions. The comparator may be adapted to characterize said first and second digital images as first and second histograms and to compare said histograms to identify changes between said histograms representative of the presence or absence of slag, the histograms optionally representing pixel intensity levels that may have been adjusted on the basis of automatic gain control levels read from said digital imaging device. The comparator may perform at least the following three steps. The first step is to identify the first and second digital images respectively as first and second sets of areas of similarity, said areas of similarity being connected areas of pixels, and defines said areas of similarity on the basis of texture and intensity of said images. The second step is to define first and second subsets of the respective first and second sets of areas of similarity and the third step is to compare at least one selected property of each of said first and second subsets against a defined parameter for said property, outside of which parameter said property is indicative of the presence or absence of slag. One parameter of the areas of similarity that the comparator may examine is an aspect ratio of height to width of said area. The comparator may also identify first and second areas of similarity, as above, and then builds histograms based on at least one selected property of said first and second subsets which is indicative of the presence or absence of slag in said stream.

The present invention also provides a system for representing the slag content of a molten metal stream comprising at least the following four elements. The first element is a digital imaging device for providing a digital image of said molten metal stream. The second element is a memory, operatively connected to the digital imaging device, for storing said digital image. The third element is a comparator, operatively connected to the memory, for identifying the digital images as a set of areas of similarity, said areas of similarity being connected areas of pixels and defined on the basis of texture and intensity of said images, defining a subset of the areas of similarity and comparing at least one selected property of said subset against a defined parameter for said property, outside of which parameter said property is indicative of the presence or absence of slag. The fourth element is a processor, operatively connected to the comparator, for generating output signals based upon the results of said comparison which are representative of the presence or absence of slag in said molten metal stream.

The imaging device can be a charge coupled device, or it can be sensitive to wavelengths less than 4 microns, and it may include an optical filter such as a neutral density filter or a cobalt blue filter.

BRIEF DESCRIPTION OF THE DRAWINGS

Exemplary embodiments of the invention will now be further described with references to the drawings in which.

DETAILED DESCRIPTION OF THE INVENTION

Figure 1:
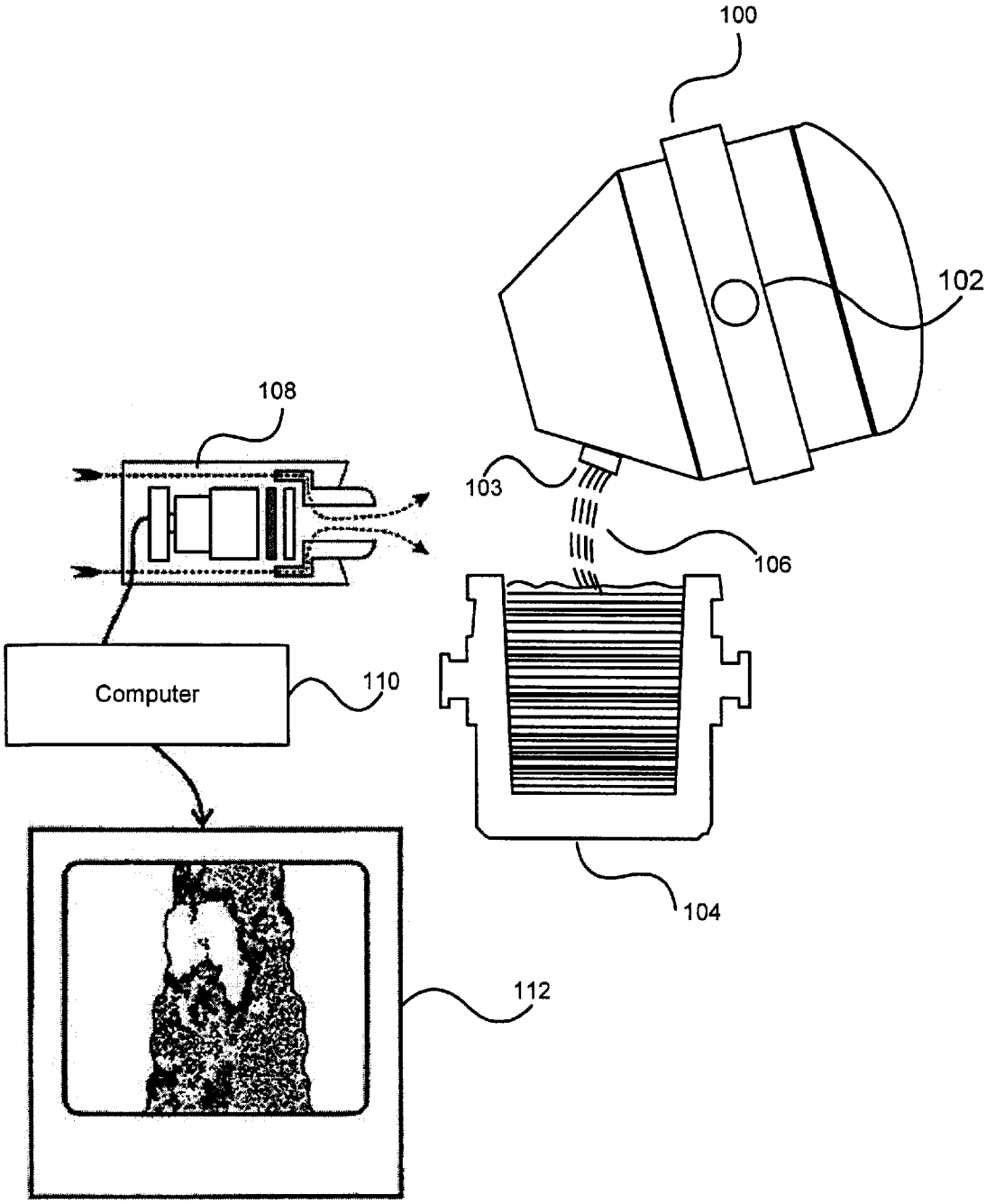
FIG. 1 illustrates a system to detect slag in a molten metal flow.

FIG. 1 is an overview of the invention described in the context of slag carryover between a BOF and a ladle, although the invention is equally applicable to other stages in the molten metal flow, such as between a ladle and a tundish, or a tundish and a mould. A BOF 100, containing molten metal and slag, is pivoted about an axis 102. As the BOF 100 is pivoted, the slag remains in a layer at the top of the BOF 100. A tap 103 below the slag level is opened to allow a molten metal stream 106 to pour into a ladle 104. A digital imaging device 108 captures digital images of the molten metal stream and feeds them to a computer 110 for analysis and processing. The processed image and other relevant information as described below is then displayed on a monitor 112.

The digital imaging device 108 is unlike the equipment used in prior art methods. Whereas prior art methods have employed expensive infrared imaging equipment, a less expensive method of detecting slag in a molten metal flow is possible through the use of digital imaging the molten metal stream 106 using a standard charge coupled device (CCD) video device 108 such as a video camera. The CCD detects wavelengths from the visible part of the spectrum into the near infrared, typically wavelengths less than 4 microns.

To enhance the image taken by the camera 108, a computer 110 is employed to perform image processing and data analysis. The camera 108 provides the computer with frame by frame images for analysis. This could be done with a digital still camera that is set to provide images at a fixed interval, but a video camera is preferred due to its frame rate.

Whereas traditional methods of measuring the slag in the tap stream have relied upon absolute standards, the method of the present invention measures relative differences in the tap stream. This obviates the need for frequent and costly recalibrations because the same camera is used for both images being compared, thus any shift in the calibration is cancelled. The method relies upon taking a succession of digital images of the molten metal flow using the camera 108 and then comparing the properties of the two images to achieve a measure of the difference between the images, herein referred to as the molten metal flow "delta". The images that are compared to each other can be successive images, or they could be images spaced apart by a defined time interval. Optionally the first image can also be a composite of several images, derived by an arbitrary averaging feature. As the computer 110 analyzes the images, it displays them on a monitor. The displayed images are enhanced through the computer analysis to provide both visual cues and numerical information about the slag in the molten metal flow. These enhancements aid the operator in evaluating the slag content to determine a point at which to cease the molten metal flow by closing the tap 103 and returning the BOF 100 to an upright position. The enhancements include the colorization of the slag to provide a high degree of contrast between the metal flow and the slag, as well as the addition of numerical information, such as the percentage of the current flow that is slag, as an overlay on the image of the molten metal flow. In addition, the molten metal flow delta, i.e. the difference between the images, can be displayed to allow the operator to see the manner in which the flow composition is changing.

Figure 2:
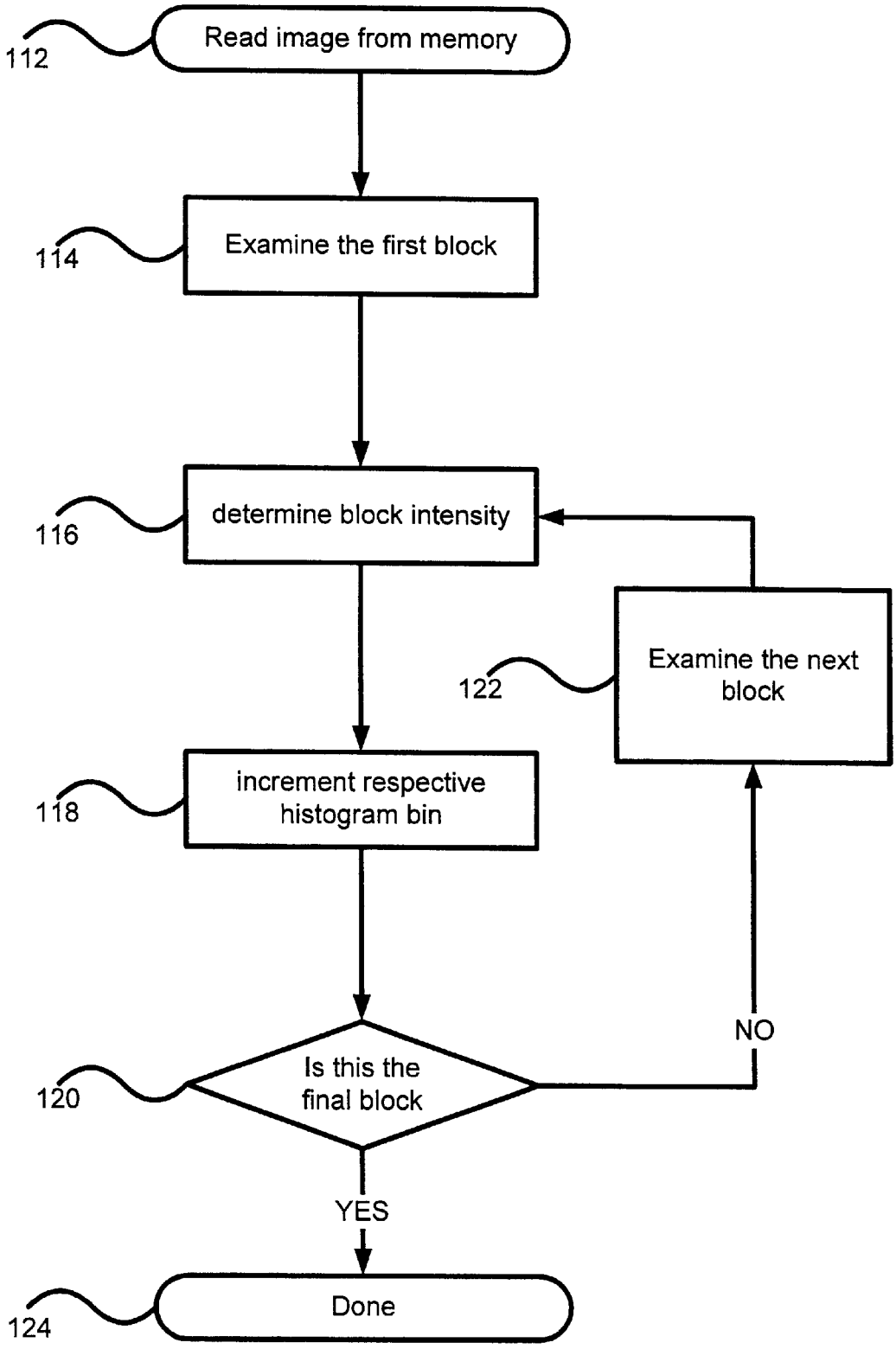
FIG. 2 illustrates a flow chart of a method to create a histogram for characterizing an image of a molten metal flow.

The analysis of the images can be done in several different ways. One embodiment of the invention relies upon what is termed the "histogram intensity method". This method allows for the rapid characterization of the images into a format that renders it easy to compare the images and arrive at a molten metal flow delta. FIG. 2 illustrates the histogram intensity method. The image taken by the camera is stored in memory from which it is read in a first step 112. This stored image is comprised of discrete blocks, typically pixels. The first block of the image is examined in a following step 114. The method works with blocks of different sizes, but in the current embodiment, each block is one pixel, to maximize the resolution of the image and information provided. By examining blocks that are greater in size than one pixel, it is possible to process the images more quickly but this comes at the expense of accuracy, resulting from the decreased resolution of the images. The next step 116 determines the intensity of the block. The intensity of the block is a composite of factors including both the wavelengths of light captured and temperature from the area of the molten stream represented by the block. The temperature and emitted wavelengths of slag differ from that of molten metal, allowing the computer system to differentiate the two. The determination of the intensity can be done through the use of a look up table, where the wavelengths received are mapped to different temperatures, and the information is rounded so that it can fit into bins created for the histogram. After determining the intensity of the block, the histogram bin that best fits the block is incremented at 118. After incrementing the histogram bin, a decision 120 is made on whether this is the final block or there are additional blocks. If more blocks are present, the process will repeat on the next block at 122 or will terminate at 124 if there are no further blocks to examine. Because the histogram further discretizes the image, and reduces the amount of information stored, it allows simpler and more quantifiable comparisons between images. Typically, the most relevant information to the determination of the molten metal flow delta is the increase in the number of pixels whose intensity exceeds a given threshold, as that information is directly related to the amount of slag present in the molten metal flow. The histogram allows the calculation of this increase through simple addition and subtraction. After processing two images, the molten metal flow delta can be calculated in numerous ways. One such method is to calculate the molten metal flow delta to reflect the increase in the number of pixels over a specified wavelength threshold. Because the slag has a different colour than the molten metal in the images, it is possible to set an arbitrary wavelength threshold above which all increases are attributed to the presence of slag. The histogram provides information that can be displayed on the monitor 112. Because pixels with a given range of wavelengths are attributed to slag, the number of pixels representing slag and the percentage of the screen representing slag can easily be shown to the operator by overlaying the image onto the display. The change in this value, between frames, representing the molten metal flow delta, can also be displayed to the operator. In an alternate embodiment, a level meter can display the information, or an alarm can be activated when the level of slag exceeds a threshold.

Figure 3:
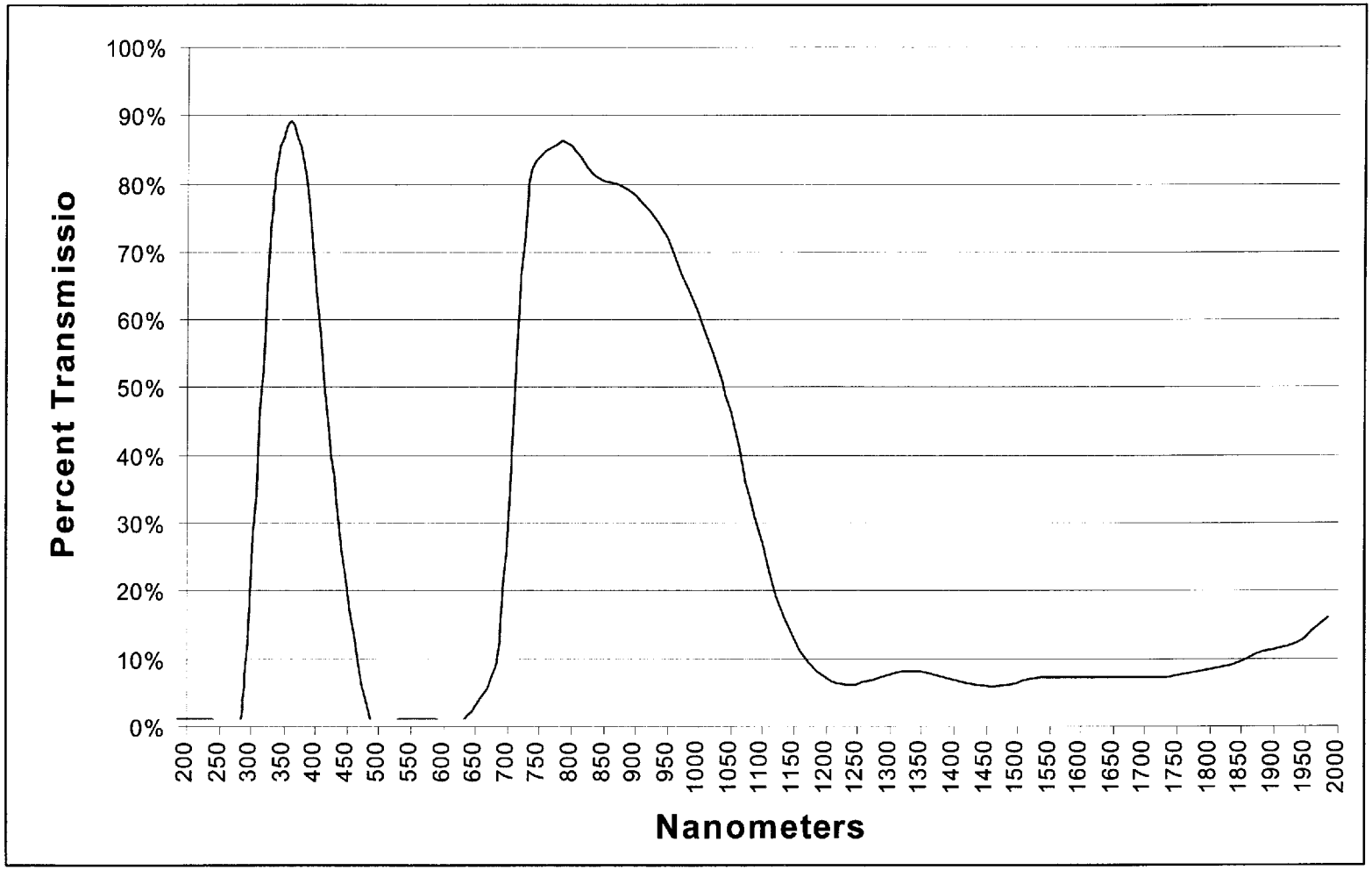
FIG. 3 illustrates the effect of a Cobalt Blue Filter on the transmission of various wavelengths of light.

Certain modifications to the equipment can be implemented to enhance the performance of the above described system. These modifications include the use of a filter on the lens of the camera. A neutral density filter, such as a standard number 3 welding filter can be used to decrease the intensity of the image so as to avoid saturating the CCD and making the differentiation unnecessarily difficult. The filter can be chosen so that the intensity of the molten stream is received near the middle of the range of the CCD. As an example, an 8 bit CCD is capable of discerning 256 discrete levels of intensity, so a filter should be selected which places the slag stream at a level close to level 128. Another type of filter, namely a blue cobalt filter, offers other advantages. Whereas a standard filter simply decreases the intensity of the received image, a cobalt blue filter is designed to block our certain wavelengths of light (typically those between 450 and 700 nanometers), that happen to reside between the wavelengths that the molten steel emits and those that the slag emits. Thus the filter increases the contrast between the two parts of the image. FIG. 3 illustrates the wavelengths blocked by a cobalt blue filter. As shown in FIG. 3, wavelengths between 450 and 700 nanometers are almost completely blocked by a cobalt blue filter. This filter allows the camera to provide greater contrast between the molten steel, which typically emits radiation of wavelengths less than 450 nanometers, and the slag, which typically emits radiation of wavelengths greater than 700 nanometers. Use of this filter assists in the creation of the intensity histogram as it reduces the number of errors in categorizing elements between the slag and molten metal. In addition, it allows for greater flexibility in setting a threshold above which differences are considered for the molten metal flow delta.

Another modification that can be used to assist the development of the intensity histogram is the use of automatic gain control. Many modern video cameras have an automatic gain control, which typically is disabled for this system, but in an alternate embodiment the automatic gain control can be enabled. In standard operation, the automatic gain control attempts to adjust the intensity of the image to prevent images form being too bright. An increase in the slag content present in the molten metal stream will result in an increase in the overall intensity of the molten metal flow. This increase in the intensity of the molten metal flow will result in the automatic gain control system increasing its levels to offset the intensity increase. In one embodiment of the invention the automatic gain control levels can be used to alter the threshold at which elements of the image are considered to be slag. As a result of the automatic gain control portions of the image that would normally have an intensity representative of slag will have a diminished intensity, and so an adjusted threshold is required, and can be derived from the automatic gain control levels. Another embodiment of the current invention relies upon changes in the automatic gain control levels to provide information on slag content. As more slag entrains the molten metal stream the overall brightness of the stream will increase, resulting in an increase in the automatic gain control levels. Monitoring of these levels is used in this embodiment as the sole indicator of the presence of slag in the molten metal stream. Analysis of the automatic gain control levels can be done with respect to an absolute threshold, or can be done in the form of a change between frames.

Figure 4:
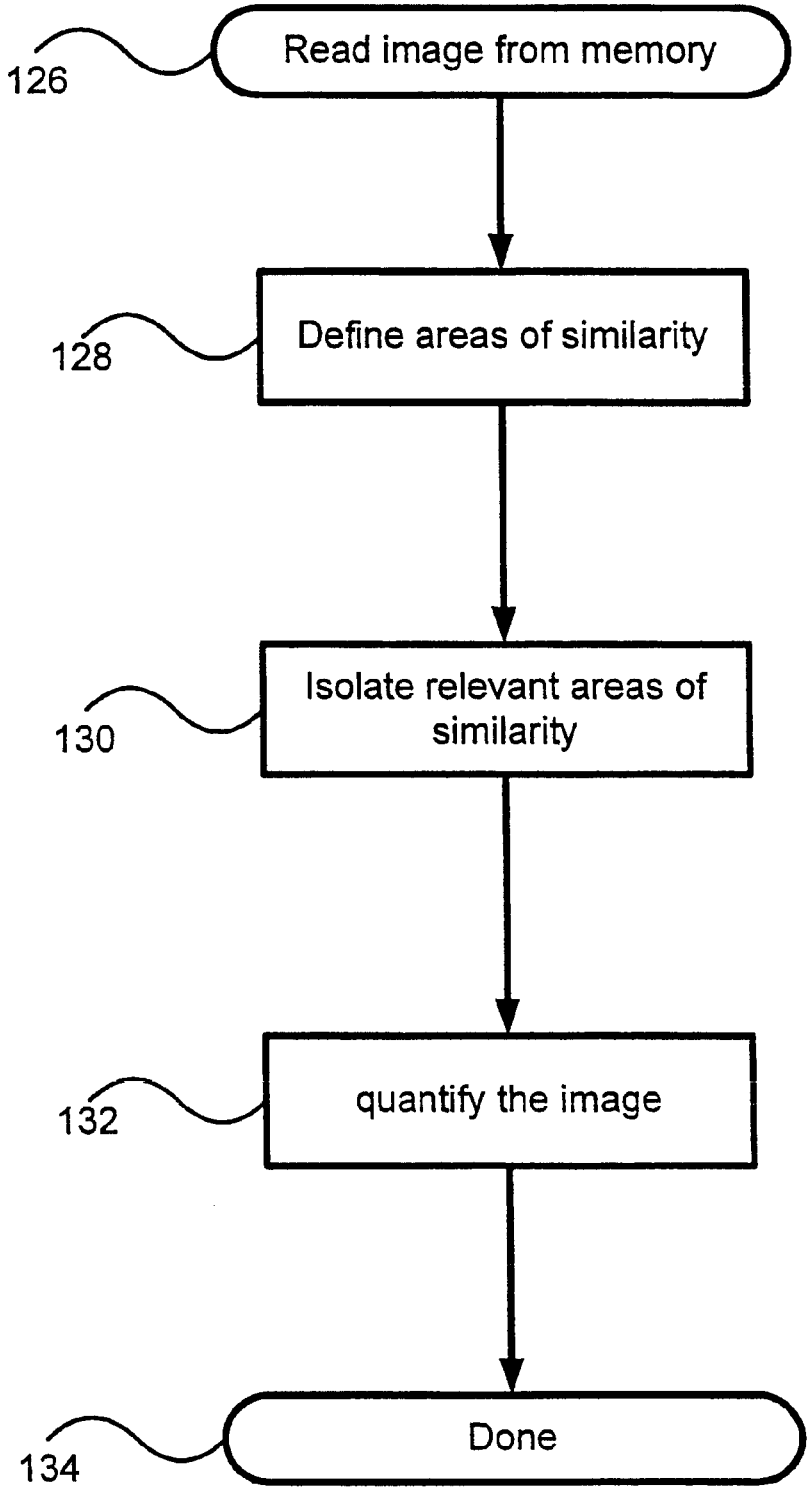
FIG. 4 illustrates a method of quantifying an image based on characteristics of areas of similarity.

In an alternate embodiment, the intensity of the pixels is no longer the primary indicator of the presence of slag. Instead analysis is performed through a texture mapping process known as "blob analysis". This method also makes use of a histogram to aid in a discrete analysis of the images but relies upon blob analysis for the identification of information to be stored and analyzed. Blob analysis identifies areas of similarity on the image that are composed of connected regions of pixels that share defined characteristics, these areas of similarity being known as blobs. The characteristics used to define blobs in this embodiment are the intensity and wavelength of the emitted radiation. Typically, blob analysis is used to separate the blobs from the background so that the blobs can be analyzed in isolation. The analysis of the blobs allows the image to be quantified on the basis of predetermined characteristics. This technique is computationally expensive, so to allow real time (or near real time) operation, only blobs with interesting characteristics are considered. In this embodiment, interesting characteristics include having wavelengths greater than 700 nanometers and intensity over a predetermined threshold. FIG. 4 illustrates the above-described method. In a first step 126 the image is again read from memory. The image is then processed at 128 to define areas of similarity, i.e. blobs. The relevant areas of similarity are isolated from the rest of the image at 130, so that the computationally intensive tasks are only performed on the relevant parts of the original image. After isolating the relevant blobs in the previous step, the image is quantified at 132, so that there is a set of characteristics used to define the image in terms of the characteristics and type of blobs that are present. These characteristics, as described earlier, include the wavelengths and intensity of the blob, and may additionally contain information on the size of the blob. This quantification process is the final step before the process terminates at 134. The displayed image can be enhanced with the information gathered through blob analysis to visually alert an operator of the presence of slag. Because the blobs were separated from the image at step 130 it is possible to represent them on the screen in a distinct fashion. In one embodiment the blobs are converted from a greyscale image into a colour such as red, thus causing them to stand out from the molten metal flow, which is displayed as a greyscale image. This process can be repeated for the different frames being analyzed so that each frame will have a similarly quantified representation. After the process has been performed on two images they can be compared to each other. For the purposes of comparison, the quantification of the images can be done so that a histogram comparison can be performed, as in the previous example, allowing an easy analysis of the changing molten metal flow. In this embodiment, the histogram would allow the comparison of the images on the basis of the number of blobs of differing sizes as well as on the basis of the intensity of the blobs. The information contained in the delta can be shown on the screen numerically. Numerical information such as the number of blobs in the image, the change in the number of blobs between images, the slag content, the change in slag content between images, and other such information can be superimposed over the image of the molten metal flow, allowing the operator to use both numerical and visual information to decide when to stop the pouring.

Under blob analysis, a frame will contain the image of the molten metal flow (which has a rippled appearance), which may be entrained with slag. The slag will appear to have a more irregular surface. In a flow without slag, there will be numerous blobs identified, but the blobs will be small and have a low ratio of height to width, herein referred to as the "aspect ratio". If the aspect ratio is less than 1 then the blobs are considered to be within the range of tolerances for the molten metal flow, but when blobs having an aspect ratio greater than 1 are detected, it is an indication that slag is present. The blobs that appear in a molten metal stream arise from a number of factors including both quantization errors and turbulence in the molten metal stream. Quantization errors are unavoidable errors arising from the discrete process of digitisation, which amplifies the difference between regions on either side of an arbitrary boundary. The turbulent or non-laminar nature of the flow causes ridges and ripples in the molten metal flow. These ripples tend to be horizontally aligned so that after digitisation they appear as blobs, with low aspect ratios. If the number of relevant blobs, for example those having an aspect ratio greater than 1, between two frames increases above a determined threshold, then the monitor shows this information, because the increase in blobs is indicative of slag entering the molten metal stream. The identification of numerous smaller blobs in a clean molten metal flow can be avoided through the application of a digital filter to the image to remove artifacts in the image introduced through quantization noise.

The blobs are constructed through the analysis of the image as a 2 dimensional array. Each entry in the array, such as a pixel, is represented by an integer value intensity level. As mentioned earlier, the quantization errors that occur as a result of the digitization process can be compensated for through the use of a digital filter or a smoothing function such as a linear filtering routine. The filtering routine allows for both the creation of smooth edges for the blobs instead of the jagged edges that may appear in the original array and for reducing the number of misidentified blobs. Since a blob is categorized as an adjoining region of similar characteristics, the background can be considered a special case of a blob, and would thus be discarded as an irrelevant blob. Therefore after filtering the image, it is possible to separate the blobs from the background, which except for the most severe situations, will be contiguous. After discarding the information for the background, filters can be applied to reduce the effects of noise, and then the blobs can be classified by their number, size, distribution and aspect ratios. If this information is gathered for two adjacent frames then the frames can be compared directly or indirectly, such as through the use of a histogram, to arrive at a molten metal flow delta which can be shown to the operator by overlaying the information on the monitor 112.

Figure 5:
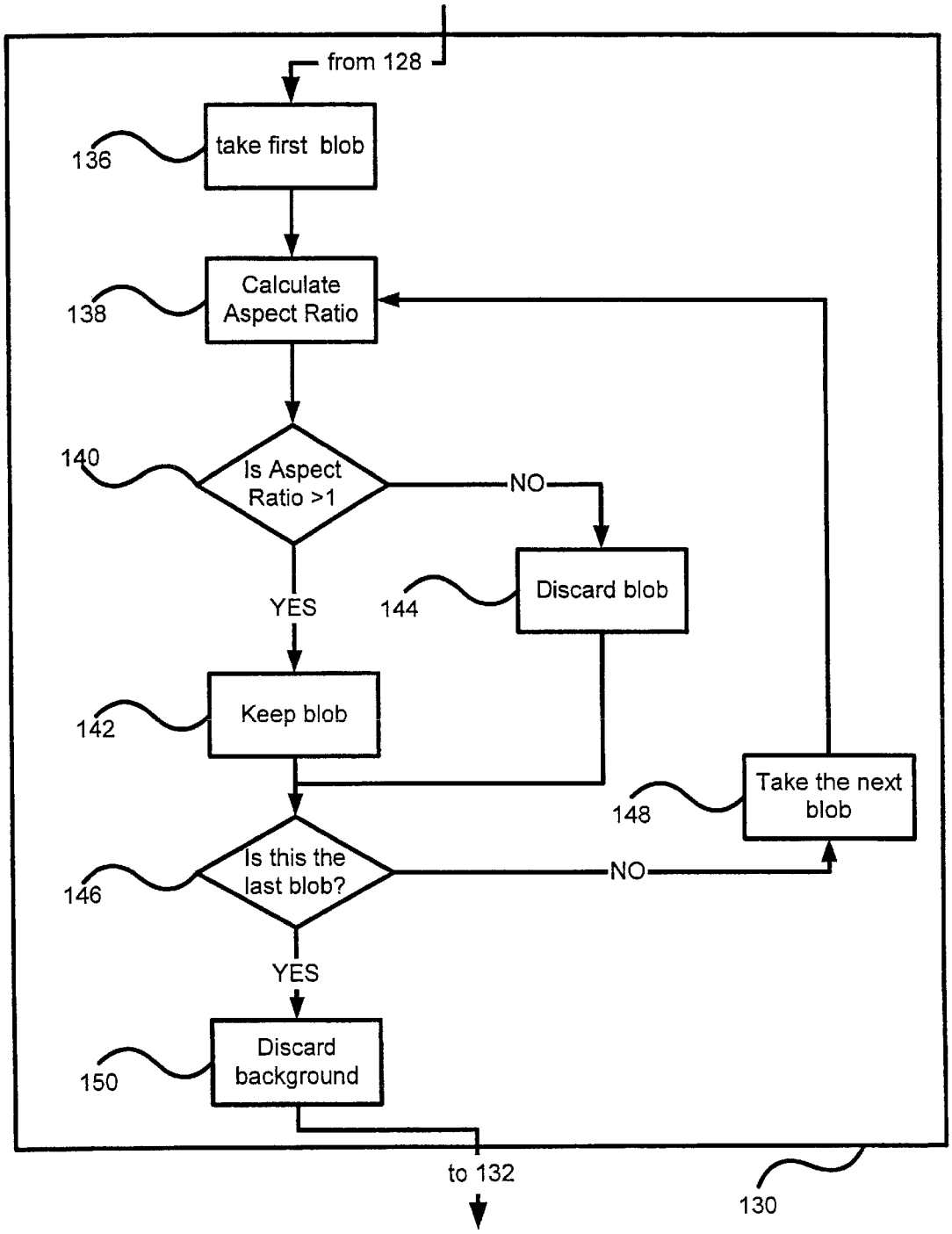
FIG. 5 illustrates a method of isolating areas of similarity.
Figure 6:
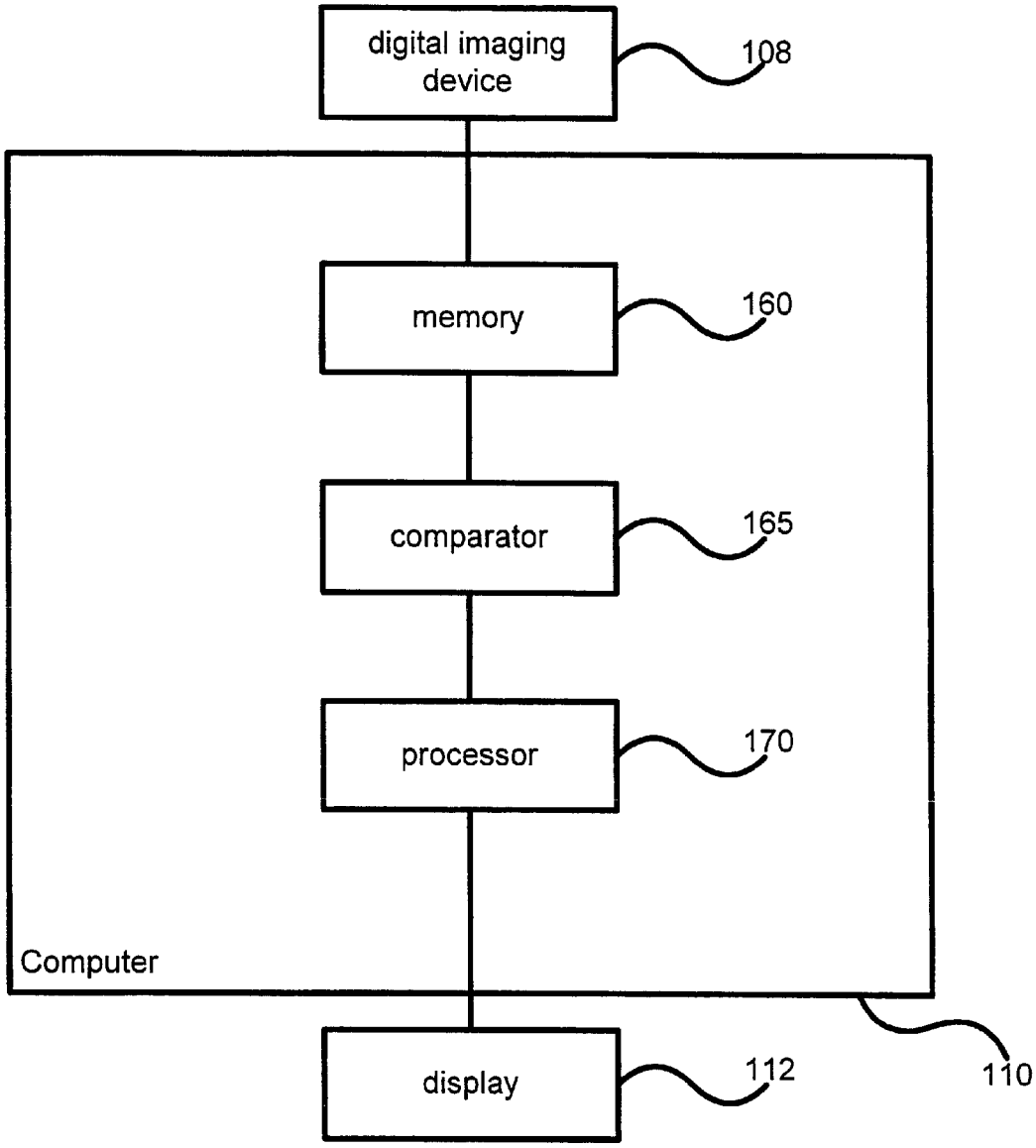
FIG. 6 illustrates a in further detail elements in the computer of FIG. 1.

FIG. 5 illustrates one method of isolating relevant areas of similarity, using some of the techniques described above. The result of step 128 in FIG. 4 is provided to the first sub element of step 130, which starts with the first blob at 136. The aspect ratio of the blob is calculated at 138, and a decision is made at 140 as to whether the aspect ratio exceeds a predetermined threshold, in this case 1. If the aspect ratio is exceeded then the blob is considered to be relevant and is kept in memory in step 142 for further analysis in step 132, otherwise the blob is considered to be irrelevant and is discarded at 144. A decision is made at 146 as to whether this is the last blob or there are more blobs in the image. If the blob was not the last one, then the next blob in the image is selected at 148 and the process returns to step 136, where the aspect ratio is calculated. If the blob was the last one, the background is discarded at 150, and the information about the remaining blobs is passed to step 132 of FIG. 4 where the image is quantified on the basis of the characteristics of the blobs.

FIG. 5 is an overview of a system for implementing the method of the present invention. The digital imaging device 108, provides digital images of the molten metal stream to the computer 110, to perform an analysis of slag in the molten metal stream. The computer is comprised of several elements, including a memory 160, which receives and stores the digital images provided by the digital imaging device 108. The memory 160 is connected to a comparator 165, to allow the comparator 165 to analyse at least one property of the images stored in the memory 160 and provide an comparison signal. The comparison signal is provided to a processor 170, which receives the comparison signal and provides an output signal based on the results provided by the comparator 165. The output signal is representative of the presence or absence of slag in the molten metal stream, and is provided to the visual display 112 to allow an operator to see the results of the slag analysis.

The above-described embodiments are intended to be examples of the present invention. Alterations, modifications and variations may be effected to the particular embodiments by those of skill in the art without departing from the scope of the invention, which is defined solely by the claims. For example, the output from the computer can be fed to a control device for automatically terminating the pouring by closing the tap and returning the BOF to its upright position, either as an alternative or in addition to the visual or numerical display. Additionally, this process can be used on molten metal streams between any two vessels, such as a flow between a ladle and a tundish or between a tundish and a mould.

What is claimed is:

1. A method of representing slag in a molten metal stream comprising the steps of:

a) obtaining a storing a plurality of pairs of first and second digital images of the molten metal stream;

b) comparing one or more selected properties of one of said stored first and second digital images of each pair to the same property or properties of the other image, said property or properties being representative of the presence or absence of slag in said stream;

c) obtaining a molten metal flow delta on the basis of said comparison, said delta representing the amount of slag in said stream and the rate of change in said amount; and d) generating output signals which are representative of said molten metal flow delta.

2. A method as in claim 1, further comprising the step of applying said output signals to a visual display of said molten metal stream, said molten metal stream having regions of slag flow appearing differently from regions of metal flow wherein said output signals are selectively applied to one or the other of said regions to enhance the visual differences between said regions.

3. A method as in claim 2, wherein said output signals are selectively applied to said regions of slag flow.

4. A method as in claim 3, wherein said visual display is monochrome and said signals are selectively applied to colourize said regions of slag flow.

5. A method as in claim 1, wherein said output signals are generated following numerical analysis of the slag content as represented by said molten metal flow delta and said output signals are applied to a numerical display which is representative of the amount of slag present in the molten metal flow.

6. A method, as in claim 1, wherein the step of obtaining and storing a plurality of pairs of first and second digital images includes the step of generating first and second histograms based on the first and second digital images and wherein the step of comparing includes the step of comparing the histograms to identify changes between said histograms representative of the presence or absence of slag.

7. A method, as in claim 6, wherein the step of generating the first and second histograms further includes building said histograms based on pixel intensity levels.

8. A method, as in claim 7, wherein the images are obtained using digital imaging equipment with automatic gain control of said images and wherein said step of characterizing said histograms further comprises adjusting the pixel intensity levels on the basis of automatic gain control levels read from said digital imaging equipment.

9. A method, as in claim 1, wherein the step of comparing said first and second digital images further comprises the steps of:

i) identifying the first and second digital images respectively as first and second sets of areas of similarity, said areas of similarity being connected areas of pixels and defined on the basis of texture and intensity of said images;

ii) defining first and second subsets of the respective first and second sets of areas of similarity; and iii) comparing at least one selected property of each of said first and second subsets against a defined parameter for said property, outside of which parameter said property is indicative of the presence or absence of slag.

10. A method, as in claim 9, wherein each said subset is comprised of an area of similarity having an aspect ratio of height to width of said area, and said property comprises said aspect ratio and said parameter is a numerical value for said aspect ration in excess of which said property is indicative of the presence of slag.

11. A method, as in claim 10, wherein said numerical value is greater than or equal to one.

12. A method, as in claim 11, wherein said numerical value is one.

13. A method, as in claim 6, wherein a filter is applied to the areas of similarity before comparing their properties to reduce noise and digitization artifacts.

14. A method as in claim 8 wherein the step of characterizing the first and second digital images comprises the steps of:

i) identifying the first and second digital images respectively as first and second sets of areas of similarity, said areas of similarity being connected areas of pixels and defined on the basis of texture and intensity of said images;

ii) defining first and second subsets of the respective first and second sets of areas of similarity; and iii) building said histograms based on at least one selected property of said first and second subsets which is indicative of the presence or absence of slag in said stream.

15. A method of representing slag in a molten metal stream comprising the steps of:

a) obtaining and storing a digital image of the molten metal stream;

b) identifying a set of areas of similarity in each digital image, said areas of similarity being connected areas of pixels defined on the basis of texture and intensity of said areas;

c) defining a subset of the areas of similarity;

d) comparing at least one selected property of said subset against a defined parameter for said property, outside of which parameter said property is indicative of the presence or absence of slag; and e) generating output signals based upon the results of said comparison which are representative of the presence or absence of slag in said molten metal stream.

16. A method as in claim 15, wherein said output signals are applied to a visual display of said molten metal stream with regions of slag flow appearing differently from regions of metal flow upon said display and said output signals are selectively applied to one or the other of said regions to enhance the visual differences between said regions.

17. A method as in claim 16, wherein said output signals are selectively applied to said regions of slag flow.

18. A method as in claim 17, wherein said visual display is monochrome and said signals are selectively applied to colourize said regions of slag flow.

19. A method as in claim 16, wherein said output signals are generated following numerical analysis of the results of said comparison and said output signals are applied to a numerical display which is representative of the amount of slag present in the molten metal flow.

20. A method as in claim 1, wherein the digital imaging device is a charge coupled device.

21. A method as in claim 1, wherein the digital imaging device is sensitive to wavelengths less than 4 microns.

22. A method as in claim 1, wherein the digital imaging device includes an optical filter.

23. A method as in claim 22, wherein the filter is a neutral density filter.

24. A method as in claim 22, wherein the filter is a cobalt blue filter.

25. A method as in claim 15, wherein the digital imaging device is a charge coupled device.

26. A method as in claim 15, wherein the digital imaging device is sensitive to wavelengths less than 4 microns.

27. A method as in claim 15, wherein the digital imaging device includes an optical filter.

28. A method as in claim 27, wherein the filter is a neutral density filter.

29. A method as in claim 27, wherein the filter is a cobalt blue filter.

30. A method of reducing slag carryover into a second vessel during pouring of a molten metal stream containing slag from a first vessel into said second vessel, which comprises representing said slag in said molten metal stream in accordance with the method of claim 1 and terminating or regulating said pouring on the basis of information upon the amount of slag in said stream derived from said output signals.

31. A method of reducing slag carryover into a second vessel during pouring of a molten metal stream containing slag from a first vessel into said second vessel, which comprises representing said slag in said in accordance with the method of claim 2 and terminating or regulating said pouring on the basis of information upon the amount of slag in said stream derived from said visual display.

32. A method of reducing slag carryover into a second vessel during pouring of a molten metal stream containing slag from a first vessel into said second vessel, which comprises representing said slag in said in accordance with the method of 5 and terminating or regulating said pouring on the basis of information upon the amount of slag in said stream derived from said numerical display.

33. A system for representing the slag content of a molten metal stream comprising:

a digital imaging device for providing a plurality of pairs of first and second digital images of said molten metal stream;

a memory, operatively connected to the digital imaging device, for storing said first and second digital images;

a comparator, operatively connected to the memory, for providing a comparison signal based on a comparison of one or more selected properties of said first and second digital images in each pair which are representative of the presence or absence of slag in said stream; and a processor, operatively connected to the comparator, for receiving and processing the comparison signal to provide a molten metal flow delta which is representative of the amount of slag in said stream and the rate of change in said amount and generating output signals which are representative of said molten metal flow delta.

34. A system, as in claim 33 further comprising a visual display to which said output signals are applied, providing a visual display of said molten metal stream with regions of slag flow appearing differently from regions of metal flow upon said display, and wherein said processor selectively applies said output signals to one or the other of said regions to enhance the visual differences between said regions.

35. A system, as in claim 33 further comprising a visual display to which said output signals are applied, providing a visual display of said molten metal stream with regions of slag flow appearing differently from regions of metal flow upon said display, and wherein said processor selectively applies said output signals to said regions of slag flow to enhance the visual differences between said regions.

36. A system, as in claim 33 further comprising a monochrome display to which said output signals are applied, providing a visual display of said molten metal stream with regions of slag flow appearing differently from regions of metal flow upon said display, and wherein said processor selectively applies said output signals to colourize said regions of slag flow to enhance the visual differences between said regions.

37. A system as in claim 33, further comprising a numerical display which is representative of the amount of slag present in the molten metal flow and wherein said processor performs numerical analysis of the slag content as represented by said molten metal flow delta and applies said output signals to said numerical display.

38. A system, as in claim 33, wherein said comparator has means for:

characterising said first and second digital images as first and second histograms; and comparing said histograms to identify changes between said histograms that are representative of the presence or absence of slag.

39. A system, as in claim 33, wherein said comparator has means for:

characterising said first and second digital images as first and second histograms based on pixel intensity levels; and comparing said histograms to identify changes between said histograms that are representative of the presence or absence of slag.

40. A system, as in claim 38, wherein said digital imaging device has means for providing automatic gain control of said images and wherein said comparator has means for reading the automatic gain control from the digital imaging device and for characterizing said histograms by adjustment of the pixel intensity levels by the read automatic gain control.

41. A system as in claim 33, wherein said comparator has means for:

identifying the first and second digital images respectively as first and second sets of areas of similarity, said areas of similarity being connected areas of pixels; defining said areas of similarity on the basis of texture and intensity of said images;

defining first and second subsets of the respective first and second sets of areas of similarity; and comparing at least one selected property of each of said first and second subsets against a defined parameter for said property, outside of which parameter said property is indicative of the presence or absence of slag.

42. A system as in claim 33, wherein said comparator has means for:

identifying the first and second digital images respectively as first and second sets of areas of similarity, said areas of similarity being connected areas of pixels and each area of similarity having an aspect ratio of height to width of said area;

defining said areas of similarity on the basis of texture and intensity of said images;

defining first and second subsets of the respective first and second sets of areas of similarity; and defining said aspect ratio of each of said first and second subsets against a numerical value for said aspect ratio, outside of which value said aspect ratio is indicative of the presence or absence of slag.

43. A system, as in claim 42, wherein the comparator has means for defining said numerical value to be greater than or equal to one.

44. A system, as in claim 42, wherein the comparator has means for defining said numerical value to be one.

45. A system, as in claim 39, further including a filter operatively connected to the memory for filtering the areas of similarity in the first and second digital images to reduce noise and digitization artifacts, said filter operatively connected to the comparator for providing the comparator with filtered first and second digital images.

46. A system as in claim 39 wherein said comparator has means for:

identifying the first and second digital images respectively as first and second sets of areas of similarity, said areas of similarity being connected areas of pixels and each area of similarity having an aspect ratio of height to width of said area;

defining said areas of similarity on the basis of texture and intensity of said images;

defining first and second subsets of the respective first and second sets of areas of similarity; and building said histograms based on at least one selected property of said first and second subsets which is indicative of the presence or absence of slag in said stream.

47. A system for representing the slag content of a molten metal stream comprising:

a digital imaging device for providing a digital image of said molten metal stream, the digital image providing texture and intensity information about the molten metal stream;

a memory, operatively connected to the digital imaging device, for receiving and storing said digital image;

a comparator, operatively connected to the memory, for receiving the digital image from the memory and for identifying a set of areas of similarity in each digital image, said areas of similarity being connected areas of pixels defined on the basis of the texture and intensity information in said images, for defining a subset of the areas of similarity and comparing at least one selected property of said subset against a defined parameter for said property, outside of which parameter said property is indicative of the presence or absence of slag and for providing a comparison signal representative of the comparison of the at least one selected property and the parameter; and a processor, operatively connected to the comparator for receiving the comparison signal, for generating output signals based upon said comparison signal, the output signals representative of the presence or absence of slag in said molten metal stream.

48. A system as in claim 47, further comprising a visual display to which said output signals are applied, for providing a visualization of said molten metal stream with regions of slag flow appearing differently from regions of metal flow upon said display, and wherein said processor selectively applies said output signals to one or the other of said regions to enhance the visual differences between said regions.

49. A system, as in claim 47 further comprising a visual display to which said output signals are applied, for providing a visualisation of said molten metal stream with regions of slag flow appearing differently from regions of metal flow upon said display, and wherein said processor selectively applies said output signals to said regions of slag flow to enhance the visual differences between said regions.

50. A system, as in claim 47 further comprising a monochrome display to which said output signals are applied, for providing a visualisation of said molten metal stream with regions of slag flow appearing differently from regions of metal flow upon said display, and wherein said processor selectively applies said output signals to colourize said regions of slag flow to enhance the visual differences between said regions.

51. A system as in claim 47, further comprising a numerical display for representing the amount of slag present in the molten metal flow and wherein said processor includes numerical analysis means for performing numerical analysis of the slag content as represented by said molten metal flow delta and for applying said output signals to said numerical display.

52. A system, as in claim 47 wherein the digital imaging device is a charge coupled device.

53. A system, as in claim 47 wherein the digital imaging device is sensitive to wavelengths less than 4 microns.

54. A system, as in claim 33, wherein the digital imaging device includes an optical filter.

55. A system, as in claim 54, wherein the filter is a neutral density filter.

56. A system, as in claim 54, wherein the filter is a cobalt blue filter.

* * * * *